US010018000B2

(12) United States Patent
Ford

(10) Patent No.: US 10,018,000 B2
(45) Date of Patent: Jul. 10, 2018

(54) LATCH ASSEMBLY FOR A PUMPING SYSTEM AND METHOD THEREFOR

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days.

(21) Appl. No.: 15/440,909

(22) Filed: Feb. 23, 2017

(65) Prior Publication Data

US 2017/0248245 A1 Aug. 31, 2017

Related U.S. Application Data

(60) Provisional application No. 62/300,017, filed on Feb. 25, 2016.

(51) Int. Cl.

| | |
|---|---|
| ***E21B 17/04*** | (2006.01) |
| ***E21B 17/046*** | (2006.01) |
| ***E21B 43/12*** | (2006.01) |
| *F04B 47/00* | (2006.01) |
| *F04B 53/10* | (2006.01) |

(52) U.S. Cl.

CPC ..... *E21B 17/046* (2013.01); *E21B 43/127* (2013.01); *F04B 47/00* (2013.01); *F04B 53/10* (2013.01)

(58) Field of Classification Search

CPC .... F16K 27/02; E21B 34/06; Y10T 403/7005; Y10T 403/7007; F16B 7/20; F16B 21/02; F16B 21/04

See application file for complete search history.

(56) References Cited

U.S. PATENT DOCUMENTS

| | | | | | |
|---|---|---|---|---|---|
| 216,627 | A * | 6/1879 | Moore | F16K 27/02 | 251/223 |
| 777,623 | A * | 12/1904 | Geniack | A01C 23/042 | 137/584 |
| 3,418,708 | A * | 12/1968 | Siver | B23K 15/0046 | 219/121.12 |
| 3,776,649 | A * | 12/1973 | Kemezys | F16B 21/04 | 403/90 |
| 4,109,672 | A * | 8/1978 | Szemeredi | F16K 27/02 | 137/315.13 |

(Continued)

FOREIGN PATENT DOCUMENTS

| | | | | |
|---|---|---|---|---|
| DE | 9418554 U1 * | 1/1995 | ..... | F16K 27/02 |
| EP | 2484944 A2 * | 8/2012 | ..... | F16K 1/42 |

(Continued)

*Primary Examiner* — Jonathan P Masinick

(74) *Attorney, Agent, or Firm* — Weiss & Moy, P.C.; Veronica-Adele R. Cao; Karen J. S. Fouts

(57) ABSTRACT

A latch assembly comprises a top latch portion, a spring, and a valve rod guide. The top latch portion has two prongs with the spring positioned therebetween. The valve rod guide has two corresponding notches to receive the two prongs. When the top latch portion is lowered toward the valve rod guide, the spring compresses against the northern end of the valve rod guide and the prongs engage the notches on the valve rod guide, thus firmly coupling the top latch portion to the valve rod guide. The latch assembly may also have a stabilizer, such as a collet adapter, coupled to a northern end of the top latch portion. The latch assembly may be used with a valve rod or a hollow valve rod.

20 Claims, 8 Drawing Sheets

(56) References Cited

U.S. PATENT DOCUMENTS 5,096,158 A * 3/1992 Burdick ..... F01M 11/0408 137/315.25
5,271,429 A * 12/1993 Bauer ..... B01D 35/147 137/543.23
5,362,187 A * 11/1994 Scalise ..... F16B 21/04 411/350
5,546,980 A * 8/1996 Kosarzecki ..... F16K 27/02 137/454.5
6,126,359 A * 10/2000 Dittrich ..... A61B 17/29 403/325
6,297,741 B1 * 10/2001 Higgins ..... F15B 21/041 340/631
6,460,826 B1 * 10/2002 Rezvani ..... F16K 27/02 137/271
9,714,718 B2 * 7/2017 Rogala ..... F16K 27/029
2003/0089875 A1 * 5/2003 Hall ..... F16C 29/02 251/214
2005/0123346 A1 * 6/2005 Nakamura ..... F16B 7/0406 403/348
2008/0246618 A1 * 10/2008 Siber ..... G08B 17/10 340/577
2008/0298928 A1 * 12/2008 Ling ..... F16B 19/109 411/511
2009/0044655 A1 * 2/2009 DeLouis ..... B25J 15/04 74/490.05
2011/0110716 A1 * 5/2011 Slater ..... A61F 2/4684 403/348
2011/0120735 A1 * 5/2011 Huang ..... A62C 2/14 169/56
2012/0000050 A1 * 1/2012 Ravindran ..... B25J 15/04 29/428
2012/0149489 A1 * 6/2012 Wall, Jr. ..... A63B 53/10 473/316
2013/0161946 A1 * 6/2013 Baumgartner ..... B60R 21/2171 285/402
2014/0086674 A1 * 3/2014 Tsugawa ..... G05G 1/025 403/299
2014/0109973 A1 * 4/2014 Neumeister ..... F16K 41/10 137/1
2015/0086295 A1 * 3/2015 Cameron ..... F16B 37/14 411/429
2015/0139723 A1 * 5/2015 Hsu ..... F16B 3/00 403/348
2015/0173466 A1 * 6/2015 Shimizu ..... F16B 21/02 24/598.1
2015/0362003 A1 * 12/2015 Tseng ..... F16B 21/02 411/103

FOREIGN PATENT DOCUMENTS

FR 2498723 A1 * 7/1982 ..... F16K 1/10
WO WO 2013134496 A2 * 9/2013 ..... F16K 31/0655
WO WO 2015028262 A1 * 3/2015 ..... G05D 16/0655
WO WO 2016070255 A1 * 5/2016 ..... F16K 31/52408

* cited by examiner

LATCH ASSEMBLY FOR A PUMPING SYSTEM AND METHOD THEREFOR

CROSS-REFERENCE TO RELATED APPLICATION

This application claims priority to U.S. Provisional Application No. 62/300,017, entitled "Latch for a Pumping System and Method Therefor," which was filed on Feb. 25, 2016 in the name of the inventor herein, and which is incorporated in full herein by reference.

FIELD OF THE INVENTION

The present invention generally relates to oil pumps, and more specifically, to a latch assembly for a pumping system and related method therefor.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft is lined with piping known as "tubing." A sucker rod, which is ultimately, indirectly coupled at its north end to the pumping unit is inserted into the tubing. The sucker rod is coupled at its south end indirectly to the oil pump itself, which is also located within the tubing, which is sealed at its base to the tubing. The sucker rod couples to the oil pump at a coupling known as a 3-wing cage.

Beginning at the south end, oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off of its seat, and oil is prevented from dropping back into the hole by the seating of the ball.

North of the standing valve, coupled to the sucker rod, is a traveling valve. The purpose of a conventional traveling valve is to regulate the passage of oil from within the pump northward in the direction of the flow line, while preventing the pumped oil from slipping back down in the direction of the standing valve and hole.

In use, oil is pumped from a hole through a series of "downstrokes" and "upstrokes" of the oil pump, wherein these motions are imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the conventional traveling valve, the ball is located in the seated position. It is held there by the pressure from the oil that has been previously pumped. The oil located above the traveling valve is moved northward in the direction of the 3-wing cage at the end of the oil pump.

During the downstroke, the ball in the conventional traveling valve unseats, permitting the oil that has passed through the standing valve to pass therethrough. Also during the downstroke, the ball in the standing valve seats, preventing the pumped oil from slipping back down into the hole.

The process repeats itself again and again, with oil essentially being moved in stages from the hole, to above the standing valve and in the oil pump, to above the travelling valve and out of the oil pump. As the oil pump fills, the oil passes through the 3-wing cage and into the tubing. As the tubing is filled, the oil passes into the flow line, from which the oil is taken to a storage tank or other such structure.

In a tubing pump, the barrel assembly is coupled to and becomes a part of the well tubing. Alternatively, with an insert pump, the complete pump is attached to the sucker rod string and is inserted into the well tubing with the sucker rod string. As a complete unit, an insert pump may be inserted and pulled out of the well without removing the well tubing.

Beginning from the south end and heading northward, an insert pump may comprise a mandrel, a standing valve, a traveling valve, a top plunger adapter, and a valve rod guide. When a conventional insert pump is inserted into the well tubing, the valve rod is typically fully extended out of the insert pump so that the traveling valve is positioned at the north end of the insert pump and away from the standing valve which is positioned at the south end of the insert pump. This causes the pump to become full of air that is trapped within the space between the traveling valve and the standing valve. When the insert pump is lowered into the well, the fluid may compress the air and the fluid may overtake the top of the insert pump and capture the air within the pump, causing gas lock.

The present invention addresses this problem encountered in the prior art pumping systems, by proving a latch system. The latch system allows the traveling valve to be fixed at the southern position of the insert pump while the insert pump is lowered into the well tubing. By having the traveling valve at the southern position, air is not allowed to collect between the traveling valve and the standing valve. As the insert pump is lowered into the well, the insert pump acts like a straw and allows the pump to be filled with fluid, not with air, thus preventing gas lock.

SUMMARY

In accordance with one embodiment of the present invention, a latch assembly for a pumping system is disclosed. The latch assembly comprises: a top latch portion, the top latch portion comprising: a body; and at least two prongs extending downwardly from the body; a spring coupled to the body of the top latch portion and positioned between the at least two prongs of the top latch portion; and a valve rod guide, the valve rod guide comprising at least two notches adapted to removably engage the at least two prongs of the top latch portion.

In accordance with another embodiment of the present invention, a latch assembly for a pumping system is disclosed. The latch assembly comprises: a top latch portion, the top latch portion comprising: a body; a center channel formed through a length of the body, wherein the center channel is adapted to receive a valve rod; an annular ridge formed within the center channel; and at least two prongs extending downwardly from the body; a spring received within a southern end of the center channel of the body of the top latch portion and positioned between the at least two prongs of the top latch portion, wherein a northern end of the spring abuts the annular ridge within the center channel of the body of the top latch portion; and a valve rod guide, the valve rod guide comprising: a center channel formed therethrough, wherein the center channel is adapted to receive the valve rod; two upper ridges formed on an outer surface of a northern end of the valve rod guide, wherein the upper ridges form at least two notches and also form at least two hooks on the outer surface of the northern end of the valve rod guide, each hook and each notch being adapted to engage a corresponding prong of the top latch portion.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
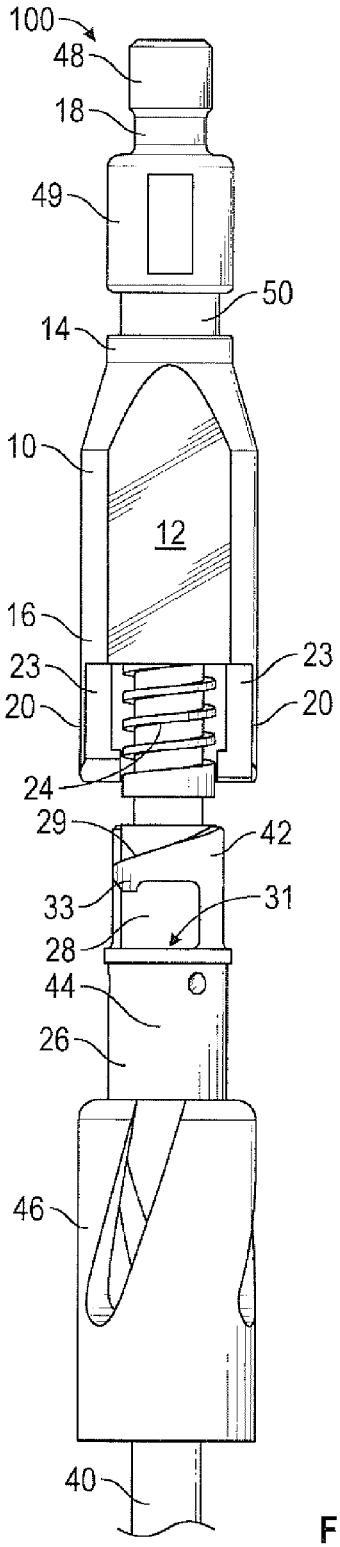
FIG. 1 is a front view of a latch assembly, in accordance with one or more aspects of the present invention.
Figure 2:
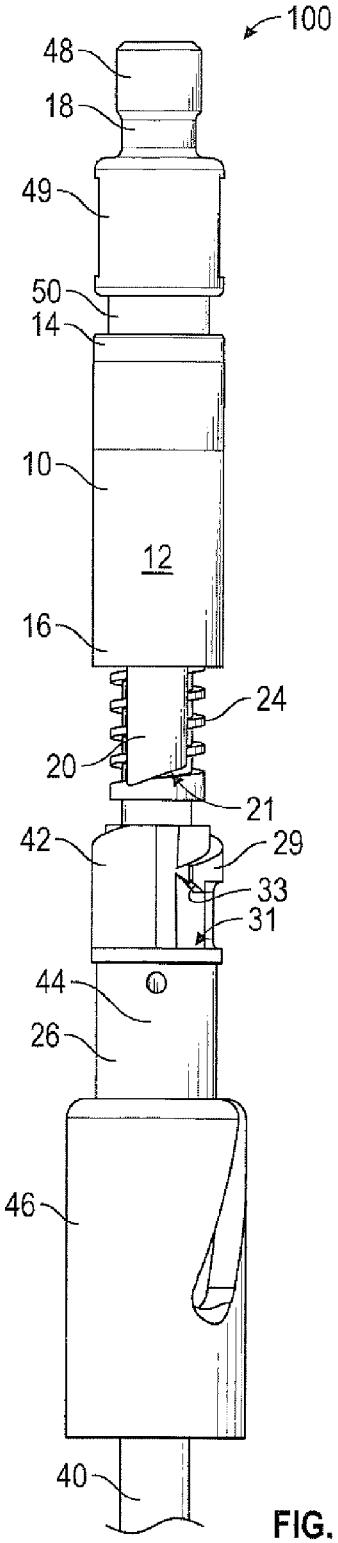
FIG. 2 is a side view of the latch assembly of FIG. 1.
Figure 3:
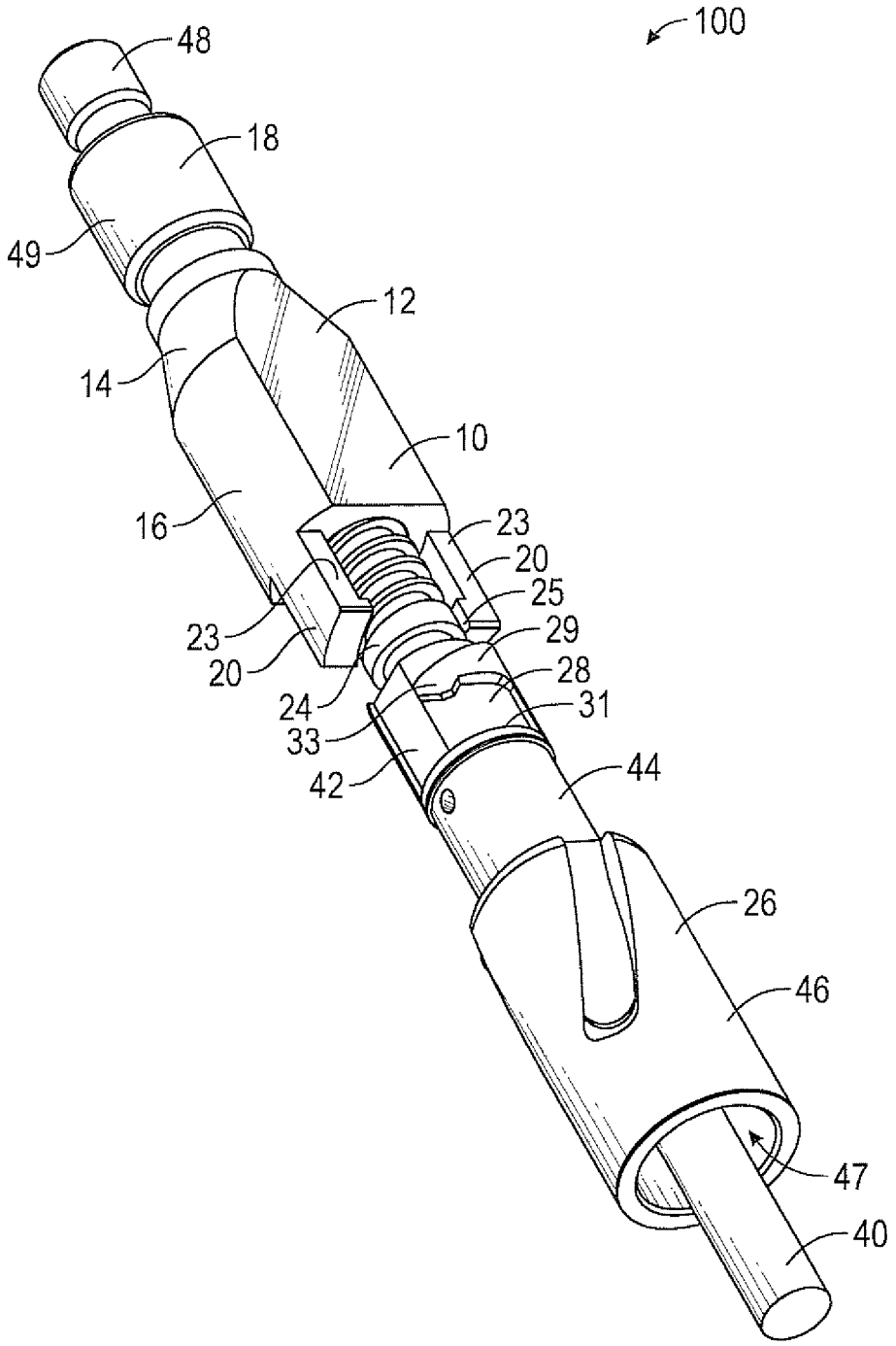
FIG. 3 is perspective view of the latch assembly of FIG. 1.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-14 together, disclose a latch assembly 100 of the present invention. Referring to FIGS. 1-3 and FIGS. 13-14, the latch assembly 100, in its simplest form, may comprise a top latch portion 10, a spring 24, and a valve rod guide 26. The latch assembly 100 may also have a stabilizer, such as a collet adapter 18, coupled to a northern end 14 of the top latch portion 10. The latch assembly 100 may be used with a valve rod 40 or a hollow valve rod.

Figure 12:
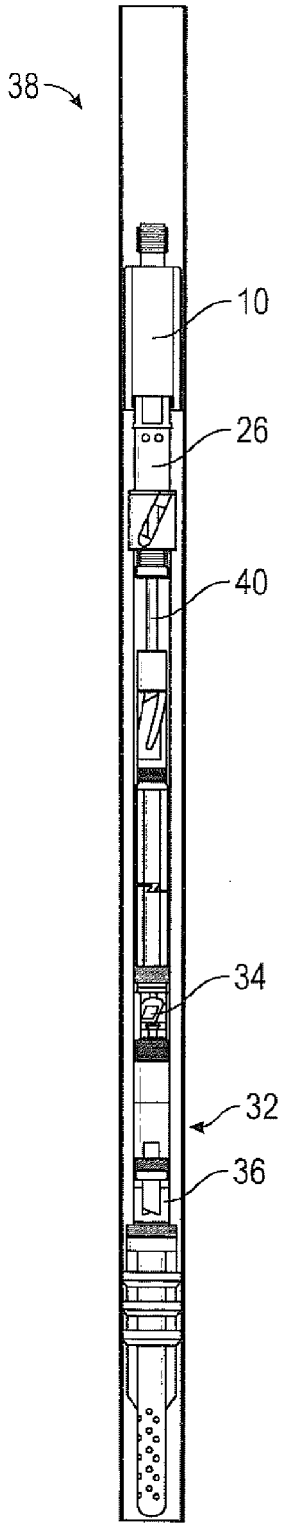
FIG. 12 is a front view of the latch assembly of FIG. 1 shown in use with a pumping system, wherein the top latch portion and the valve rod guide are shown engaged.
Figure 13:
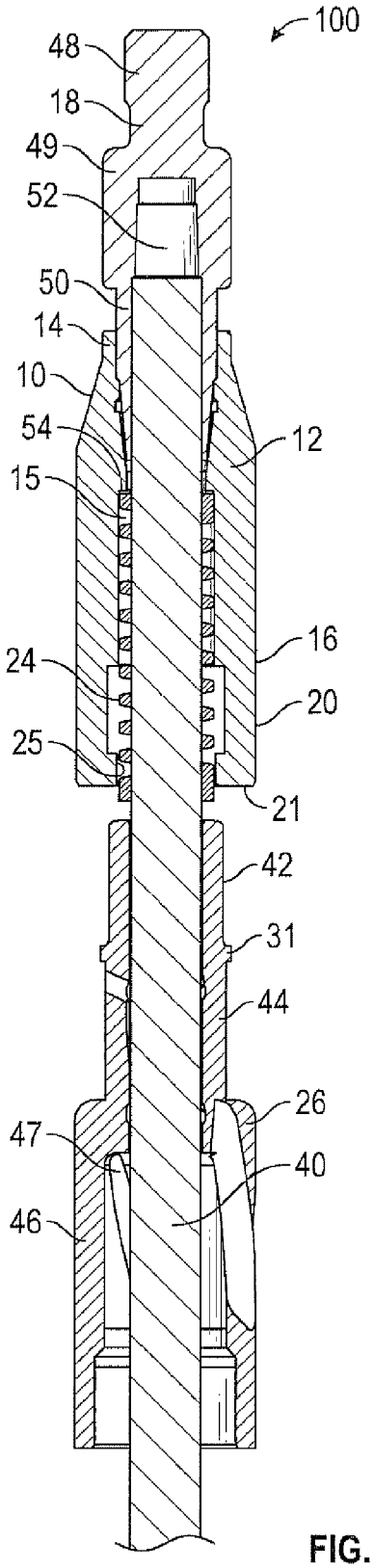
FIG. 13 is a cross-sectional view of the latch assembly of FIG. 1.

FIGS. 1-13 show a latch assembly 100 in accordance with one or more embodiments of the present invention, where FIG. 13 shows a cross-sectional view of the latch assembly 100.

Figure 4:
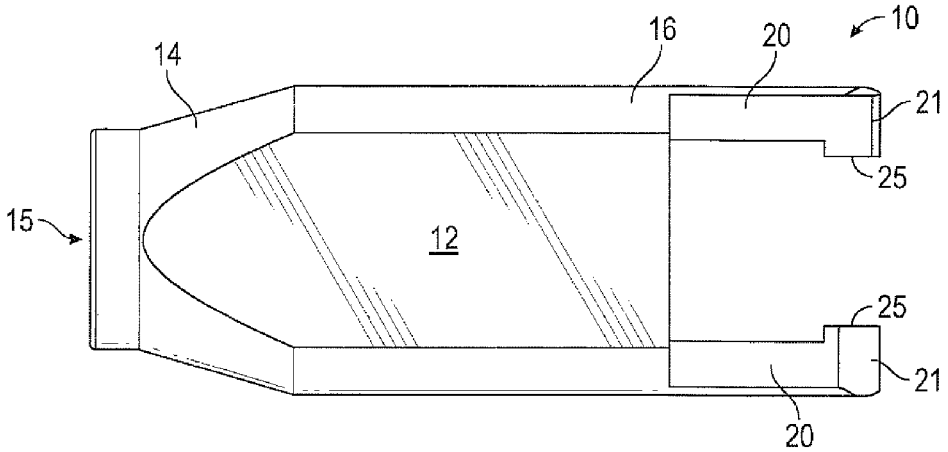
FIG. 4 is a front view of a top latch portion of the latch assembly of FIG. 1.
Figure 5:
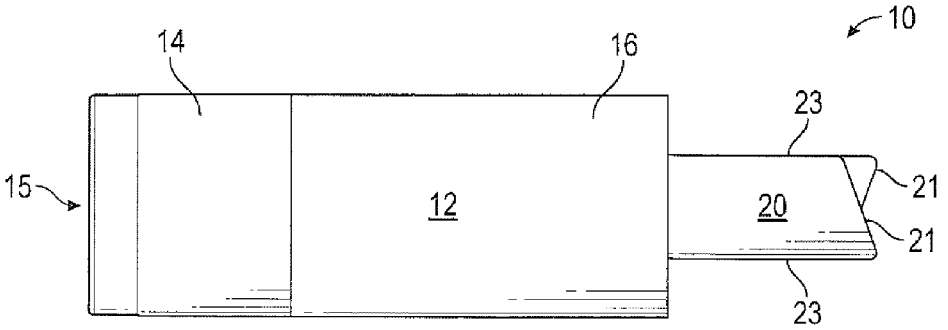
FIG. 5 is a side view of the top latch portion of FIG. 4.

FIGS. 4-5 show one embodiment of the top latch portion 10. The top latch portion 10 has a body 12 with a northern end 14 and a southern end 16. In the embodiment shown herein, the body 12 has a center channel 15 formed therethrough along its length. The center channel 15 is configured to allow a valve rod 40 (or a hollow valve rod) to pass therethrough. The southern end of the center channel 15 may have a diameter slightly larger than the outer diameter of the spring 24 so that a northern end of the spring 24 may be received and/or housed within the southern end of the center channel 15 of the top latch portion 10. In another embodiment, the northern end of the spring 24 may be integral to the southern end of the center channel 15 of the top latch portion 10. The center channel 15 may have an annular ridge 54 formed therein. The annular ridge 54 has a diameter smaller than the outer diameter of the spring 24 so that the annular ridge 54 will abut the northern end of the spring 24 and prevent it from moving further north into the center channel 15. The northern end of the center channel 15 may be tapered to correspond to the tapered southern end 50 of the collet adapter 18.

The top latch portion 10 also has at least two prongs 20 that extend downwardly from the southern end 16 of the body 12. The prongs 20 may be coupled to the southern end 16 of the body 12 of the top latch portion 10 or, alternatively, the prongs 20 may be integral to the southern end 16 of the body 12 of the top latch portion 10. The prongs 20 may be positioned opposite one another with the spring 24 positioned therebetween. The prongs 20 are configured to engage and to removably couple with the northern end 42 of the valve rod guide 26.

Referring to FIG. 4, the prongs 20 may be L-shaped or have some other similar configuration. In the embodiment disclosed herein, the number of prongs 20 on the top latch portion 10 is equal to the number of notches 28 on the northern end 42 of the valve rod guide 26. It should be clearly understood that substantial benefit may still be derived if there are an unequal number of prongs 20 and notches 28; for example, if there were two prongs 20 on the top latch portion 10 and there were four notches 28 on the northern end 42 of the valve rod guide 26 that the prongs 20 could possibly engage. The prongs 20 are configured to engage the corresponding notches 28 on the northern end 42 of the valve rod guide 26 and the southern end of the spring 24 is configured to abut the northern end 42 of the valve rod guide 26.

Referring to FIG. 5, in this embodiment, the prongs 20 each have a bottom edge 21 that is angled. Each bottom edge 21 may have an angle of approximately 40°. In other words, one side edge 23 of a prong 20 may be longer than the other side edge 23 of that same prong 20. While it is shown that the left side edge 23 of each prong 20 is longer than its right side edge 23, it should be understood that the ride side edge 23 of each prong 20 could be longer than its left side edge 23 instead, as long as it is configured to engage the corresponding notches 28 on the northern end 42 of the valve rod guide 26. It should also be clearly understood that the angle of the bottom edge 21 of each prong 20 may range from 30°-45°.

Figure 6:
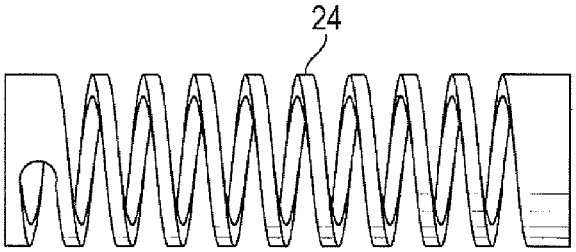
FIG. 6 is a side view of a spring of the latch assembly of FIG. 1.

FIG. 6 shows a spring 24 in accordance with one or more embodiments of the present invention. The spring 24 may be coupled to or integral with the southern end 16 of the body 12 of the top latch portion 10 and may be positioned between the prongs 20. At least a portion of the northern end of the spring 24 may be housed within the southern end of the center channel 15 proximate the southern end 16 of the body 12 of the top latch portion 10 and the remainder of the spring 24 extends downwardly and is positioned between the prongs 20. The diameter of the spring 24 is at least equal to the diameter of the northern end 42 of the valve rod guide 26 so that the southern end of the spring 24 cannot enter the center channel 47 of the valve rod guide 26. When the top latch portion 10 is lowered toward the valve rod guide 26, the southern end of the spring 24 abuts the top surface of the northern end 42 of the valve rod guide 26, causing the spring 24 to compress.

Figure 7:
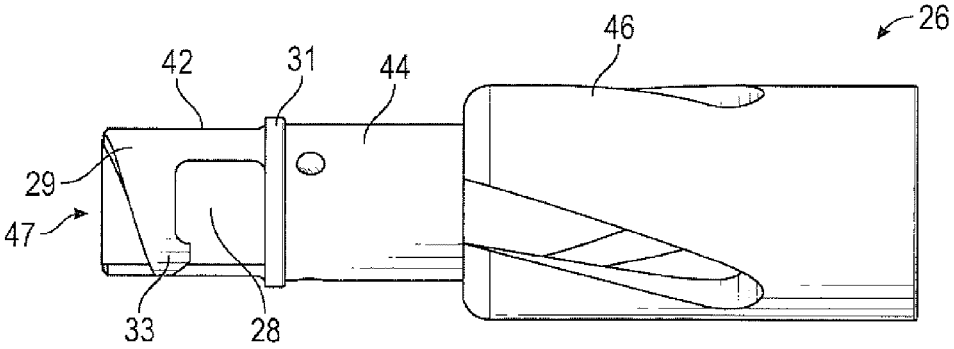
FIG. 7 is a side view of a valve rod guide of the latch assembly of FIG. 1.
Figure 8:
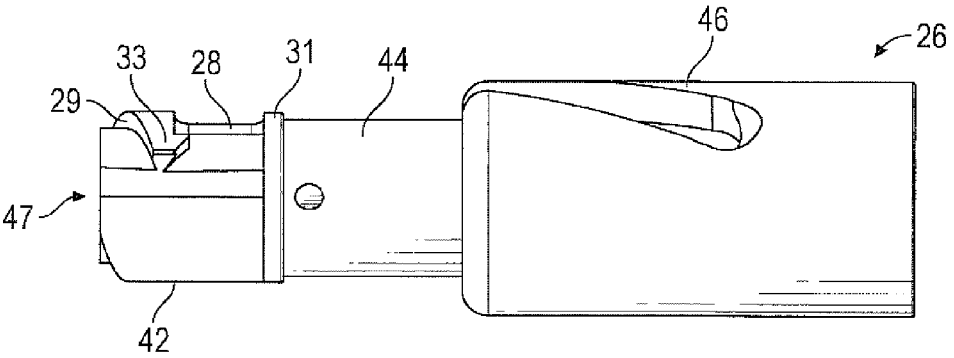
FIG. 8 is front view of the valve rod guide of FIG. 7.

FIG. 7-8 show a valve rod guide 26 in accordance with one or more embodiments of the present invention. The valve rod guide 26 has a northern end 42, a middle section 44, and a southern end 46. The southern end 46 of the valve rod guide 26 may have a larger diameter than the middle section 44 and the northern end 42 of the valve rod guide 26. The valve rod guide 26 has a center channel 47 formed therethrough, wherein the center channel 47 of the valve rod guide 26 is configured to allow a valve rod 40 (or a hollow valve rod) to pass therethrough. The northern end 42 of the valve rod guide 26 may have two upper ridges 29 formed on the outer surface thereof. It should be clearly understood that substantial benefit would still be obtained if the northern end 42 of the valve rod guide 26 had more than two upper ridges 29 or only one upper ridge 29. The upper ridges 29 may be positioned opposite from each other. Here, each of the two upper ridges 29 slopes downwardly to the left in a helical direction. As shown, the left end of each upper ridge 29 is lower than its right end. This downward slope of each upper ridge 29 is meant to mate with/correspond to the angled bottom edge 21 of a corresponding prong 20 on the top latch portion 10; i.e. if the bottom edge 21 of each prong 20 of the top latch portion 10 has an angle of approximately 40°, then its corresponding upper ridge 29 on the northern end 42 of the valve rod guide 26 will slope downwardly at approximately 40° as well.

Each upper ridge 29 slopes downwardly and forms a hook 33 and a notch 28 on the outer surface of the northern end 42 of the valve rod guide 26. Therefore, in the embodiment shown, one hook 33/notch 28 set is positioned opposite from the other hook 33/notch 28 set. The hooks 33 and notches 28 may be coupled to the northern end 42 of the valve rod guide 26 or, alternatively, the hooks 33 and notches 28 may be integral to the northern end 42 of the valve rod guide 26. Each notch 28 may have a top portion that prevents the prong 20 of the top latch portion 10 from moving upwardly once the prong 20 has engaged the hook 33 and notch 28 on the northern end 42 of the valve rod guide 26. Each notch 28 may also have a side portion that prevents the prong 20 from moving laterally in one direction when the prong 20 has engaged the hook 33 and notch 28. The width of each notch 28 may be the same as the width of the distal end of a corresponding prong 20 of the top latch portion 10. An inner surface 25 of the distal end of each prong 20 of the top latch portion 10 will engage a corresponding notch 28 on the northern end 42 of the valve rod guide 26 and a corresponding hook 33 on the northern end 42 of the valve rod guide 26 will prevent the prong 20 from moving laterally in one direction (e.g. left) and disengaging from the notch 28. The side portion of the notch 28 will prevent the prong 20 from moving laterally in the opposite direction (e.g. right). While it is shown that the upper ridge 29 slopes downwardly to the left, causing the hook 33 to be formed on the left of its corresponding notch 28, it should be clearly understood that the upper ridge 29 may instead slope downwardly to the right, causing the hook 33 to be formed on the right side of its corresponding notch 28; as long as it is configured to engage the bottom edge 21 of a corresponding prong 20 on the top latch portion 10. In other words, for example, if the bottom edges 21 of the prongs 20 of the top latch portion 10 are both angled downwardly to the left, then the corresponding upper ridges 29 on the northern end 42 of the valve rod guide 26 will also slope downwardly to the left, the hooks 33 will be formed on the left of their corresponding notches 28, and the side portion of the notch 28 would prevent the prong 20 from moving laterally to the right. The opposite would also be true; i.e. if the bottom edges 21 of the prongs 20 of the top latch portion 10 are both angled downwardly to the right, then the corresponding upper ridges 29 on the northern end 42 of the valve rod guide 26 will also slope downwardly to the right, the hooks 33 will be formed on the right of their corresponding notches 28, and the side portion of the notch 28 would prevent the prong 20 from moving laterally to the left.

The valve rod guide 26 may also have a lower ridge 31 formed on the outer surface thereof. The lower ridge 31 is positioned between the northern end 42 of the valve rod guide 26 and the middle section 44 of the valve rod guide 26. When the top latch portion 10 is lowered toward the valve rod guide 26, the lower ridge 31 helps prevent the prongs 20 of the top latch portion 10 from traveling downwardly past the northern end 42 of the valve rod guide 26. The lower ridge 31 also helps to form the bottom portion of each notch 28.

Figure 9:
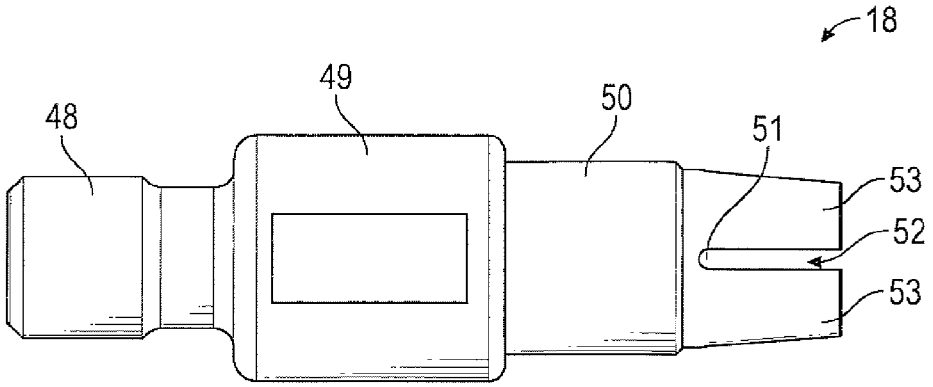
FIG. 9 is a front view of a collet adapter of the latch assembly of FIG. 1.
Figure 10:
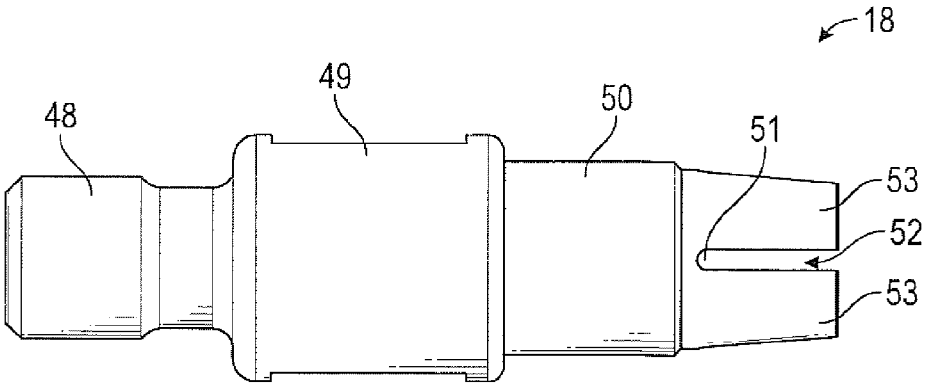
FIG. 10 is a side view of the collet adapter of the latch assembly of FIG. 9.

FIGS. 9-10 show a collet adapter 18 in accordance with one or more embodiments of the present invention. The collet adapter 18 acts as a stabilizer for the valve rod 40, preventing the valve rod 40 from moving side to side and thus preventing damage to the valve rod 40. The collet adapter 18 has a northern end 48, a middle section 49, and a southern end 50, wherein the southern end 50 of the collet adapter 18 is coupled to the center channel 15 of the top latch portion 10 proximate the northern end 14 of the top latch portion 10. The middle section 49 of the collet adapter 18 may have a larger diameter than the northern end 48 and/or the southern end 50 of the collet adapter 18. The southern end 50 of the collet adapter 18 may be removably coupled to the center channel 15 of the top latch portion 10 proximate the northern end 14 of the top latch portion 10. The southern end 50 of the collet adapter 18 and the northern end 14 of the top latch portion 10 may both have threading (the collet adapter 18 having male threading and the northern end 14 of the top latch portion 10 having female threading, or vice versa) so that the collet adapter 18 and the top latch portion 10 may be coupled by screwing them together via the corresponding male/female threading. Instead of threading, the collet adapter 18 and the top latch portion 10 may be friction fit together. Alternatively, the southern end 50 of the collet adapter 18 may be integral to the center channel 15 of the top latch portion 10 proximate the northern end 14 of the top latch portion 10.

The southern end 50 of the collet adapter 18 may be tapered for easy insertion into the center channel 15 of the top latch portion 10 proximate the northern end 14 of the top latch portion 10. Where the southern end 50 of the collet adapter 18 is tapered, the center channel 15 of the top latch portion 10 proximate the northern end 14 of the top latch portion 10 may also be tapered to receive the tapered southern end 50 of the collet adapter 18. The southern end 50 of the collet adapter 18 may also have a plurality of slits 51 formed therein, thus dividing the southern end 50 of the collet adapter 18 into a plurality of tapered ears 53. When the collet adapter 18 and the top latch portion 10 are coupled tightly together (screwed together or friction fit), the tapered northern end of the center channel 15 of the top latch portion 10 compresses the ears 53 of the tapered southern end 50 of the collet adapter 18 inwardly toward the valve rod 40. The slits 51 allow the movement of the ears 53 inwardly toward the valve rod 40. The collet adapter 18 also has a center channel 52 with an opening at its southern end 50 which extends upwardly along a portion of the length of the collet adapter 18. The center channel 52 is configured to receive and house the top end of the valve rod 40. The northern end 48 of the collet adapter 18 is coupled to the south end of a sucker rod string. In an alternative embodiment, the latch assembly 100 may not have a collet adapter 18, in which case, the top of the valve rod 40 would be coupled to the south end of the sucker rod string.

Figure 11:
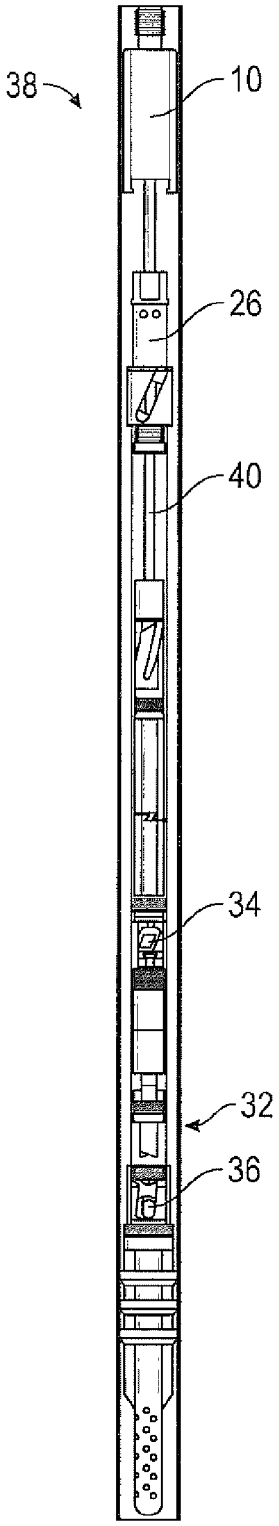
FIG. 11 is a front view of the latch assembly of FIG. 1 shown in use with a pumping system, wherein the top latch portion and the valve rod guide are shown disengaged.

FIGS. 11-12, show the latch assembly 100 in use with an insert pump 38. A pump operator or other individual may lower the top latch portion 10 until the angled bottom edges 21 of the prongs 20 of the top latch portion 10 come into contact with the downwardly sloping upper ridges 29 of the northern end 42 of the valve rod guide 26. The pump operator may then push downwardly upon the top latch portion 10, thereby compressing the spring 24. The angled bottom edges 21 of the prongs 20 and the downwardly sloping upper ridges 29 of the valve rod guide 26 will then help to drive the prongs 20 downwardly and into the notches 28. The top latch portion 10 may then be rotated until the side portions of the notches 28 stop the top latch portion 10 from moving laterally/rotating. When the pump operator stops pushing downwardly upon the top latch portion 10, the spring 24 slightly relaxes, causing the prongs 20 to move upwardly. The inner surfaces 25 of the distal ends of the prongs 20 of the top latch portion 10 then engage the hooks 33 on the northern end 42 of the valve rod guide 26 and are prevented from moving upwardly any further. The prongs 20 are also prevented from moving laterally by the side portions of the notches 28 and the hooks 33. Although the spring 24 has slightly relaxed, the spring 24 still remains compressed, thus keeping the inner surfaces 25 of the distal ends of the prongs 20 firmly engaged by the hooks 33. Once the prongs 20 have firmly engaged the notches 28, then the valve rod 40 is lowered so that the pump is secured into a position wherein the traveling valve 34 is fixed at the southern end of the insert pump 38 and is proximate the standing valve 36. In order to unlock the latch assembly 100, the pump operator can simply push downwardly upon the top latch portion 10 again to compress the spring 24 and rotate the top latch portion 10 in the opposite direction to disengage the prongs 20 from the hooks 33 and notches 28. Then the operator will lift the top latch portion 10 and slide the prongs 20 upwardly, out of the notches 28, and away from the north end of the valve rod guide 26. The traveling valve 34 may then be moved to the northern end of the insert pump 38 and away from the standing valve 36.

As shown in FIGS. 11-12, the insert pump 38 may be equipped with a dump valve assembly 32 similar to that disclosed in U.S. patent application Ser. No. 14/811,210, which was filed on Jul. 28, 2015 by the same Applicant herein and which is incorporated herein by reference. A dump valve assembly 32 comprises a seat plug that is coupled to a southern end of a traveling valve 34, wherein the seat plug has two prongs; a standing valve 36 that has two slots adapted to receive the two prongs; and a ball that is adapted to be lifted by the two prongs in order to open the standing valve. As shown in FIG. 11, when the latch assembly 100 is not engaged, the traveling valve 34 would be positioned at a northern end and away from the standing valve 36 while the insert pump 38 is lowered into the well tubing. Only after the insert pump 38 is put into position, would the pump operator be able to lower the traveling valve 34 in an attempt to engage the prongs of the seat with the ball of the standing valve 36. As shown in FIG. 12, when the latch assembly 10 is engaged, the traveling valve 34 is fixed at the southern position of the insert pump 38 so that the prongs of the seat plug may engage and unseat the ball of the standing valve 36 prior to the insert pump 38 being lowered into the well tubing. With the traveling valve 34 in this southern position, the ball of the traveling valve 34 is unseated and the ball of the standing valve 36 is also unseated. When the insert pump 38 is lowered into the well tubing, the traveling valve 34 and the standing valve 36 are both already open, thus allowing fluid to enter the insert pump 38. This prevents the pump operator from having to repeatedly attempt to lower the prongs of the seat plug into the slots of the standing valve 36 after the insert pump 38 has been lowered into the well; such repeated attempts may damage the prongs of the seat plug of the dump valve assembly 32.

Figure 14:
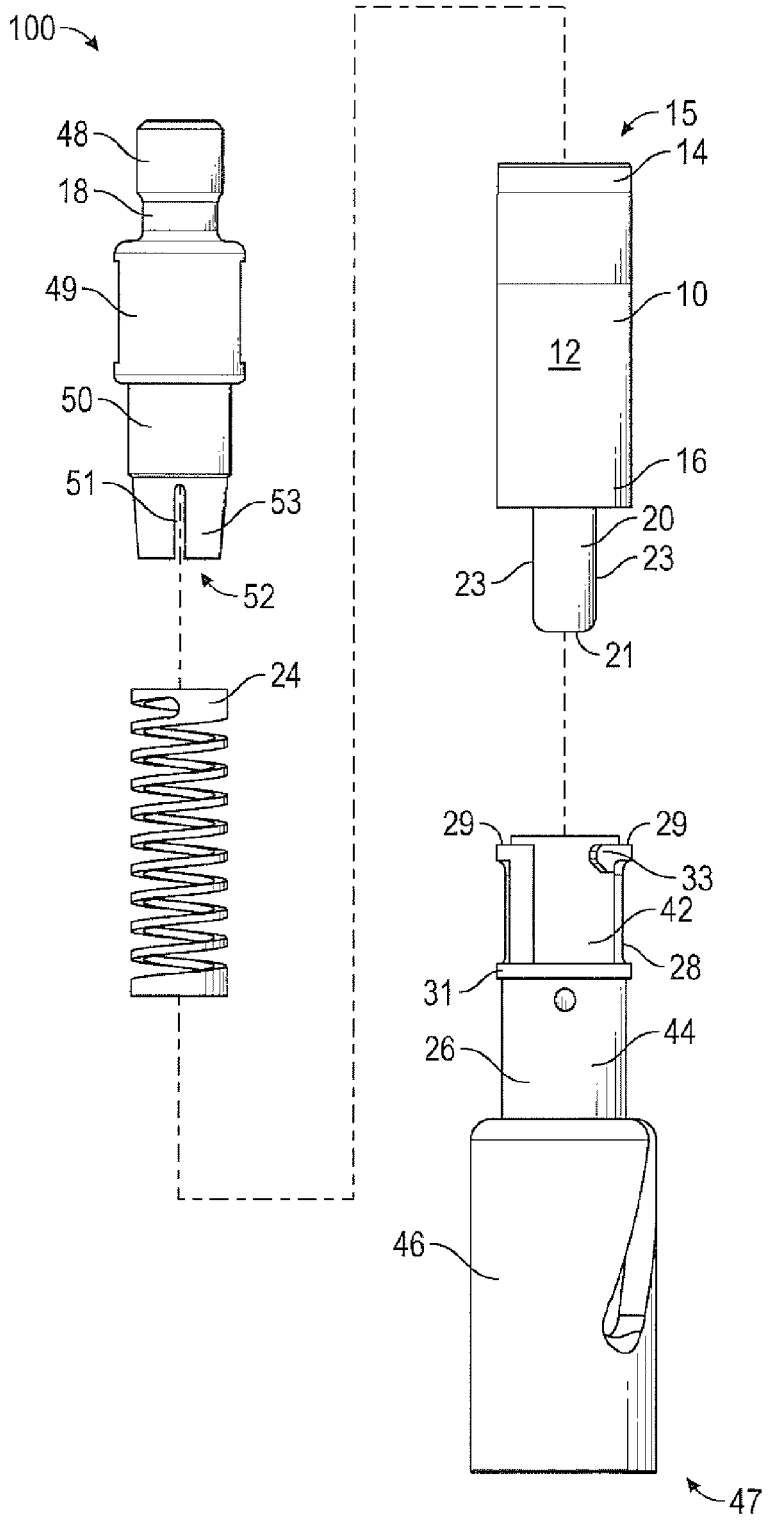
FIG. 14 is a side exploded view of another latch assembly, in accordance with one or more aspects of the present invention.

FIG. 14 shows another embodiment of the latch assembly 100. In this embodiment, the bottom edges 21 of the prongs 20 are not angled. The bottom edges 21 are flat and horizontal. Correspondingly, in this embodiment, the upper ridges 29 on the northern end 42 of the valve rod guide 26 do not slope downwardly. Instead, they are positioned flat and horizontally to engage the flat and horizontal bottom edges 21 of the prongs 20. Each of the flat upper ridges 29 still form a hook 33 and notch 28 that secures the corresponding flat prongs 20 of the top latch portion 10. All other aspects and functions of this embodiment of the latch assembly 100 are the same as described in the previous embodiment above.

In an alternative embodiment of the latch assembly 100, the top latch portion 10 may comprise female threading formed within the center channel 15 proximate the southern end 16 of the body 12. The female threading is configured to mate with corresponding male threading formed on the northern end 42 of the valve rod guide 26. With this configuration, the top latch portion 10 may be twisted relative to the valve rod guide 26 until the female threading of the top latch portion 10 fully engages the male threading of the northern end 42 of the valve rod guide 26. It should be clearly understood that substantial benefit may still be derived if the top latch portion 10 had male threading and the northern end 42 of the valve rod guide 26 had female threading. In order to unlock the latch assembly 10, the pump operator may simply rotate the top latch portion 10 in the opposite direction.

The foregoing description is illustrative of particular embodiments of the application, but is not meant to be limitation upon the practice thereof. While embodiments of the disclosure have been described in terms of various specific embodiments, those skilled in the art will recognize that the embodiments of the disclosure may be practiced with modifications within the spirit and scope of the claims.

I claim:

1. A latch assembly for use with a pumping mechanism comprising:

a top latch portion, the top latch portion comprising:

a body; and at least two prongs extending downwardly from the body, each prong comprising an outer surface and an inner surface, wherein the outer surface of each prong is substantially coplanar with an outer surface of a southern end of the body;

a spring coupled to the body of the top latch portion and positioned between the at least two prongs of the top latch portion; and a valve rod guide, the valve rod guide comprising at least two notches adapted to removably engage the inner surfaces of the at least two prongs of the top latch portion.

2. The latch assembly of claim 1 wherein the body of the top latch portion comprises a center channel formed therethrough, wherein the center channel is adapted to receive a valve rod.

3. The latch assembly of claim 2 wherein the center channel of the body of the top latch portion comprises an annular ridge formed therein, wherein a northern end of the spring is received within a southern end of the center channel and abuts the annular ridge.

4. The latch assembly of claim 2 further comprising a stabilizer, wherein a southern end of the stabilizer is coupled to the center channel of the top latch portion proximate a northern end of the top latch portion and wherein the stabilizer comprises a center channel configured to receive a top end of the valve rod.

5. The latch assembly of claim 1 wherein the prongs are L-shaped.

6. The latch assembly of claim 1 wherein the prongs of the top latch portion each have a bottom edge, wherein the bottom edges of the prongs are both flat and positioned horizontally.

7. The latch assembly of claim 1 wherein the prongs of the top latch portion each have a bottom edge, wherein the bottom edges of the prongs both have an angle between approximately 30° 45°.

8. The latch assembly of claim 1 wherein the valve rod guide comprises a center channel formed therethrough, wherein the center channel is adapted to receive a valve rod.

9. The latch assembly of claim 1 wherein the valve rod guide further comprises at least two upper ridges formed on an outer surface of a northern end of the valve rod guide.

10. The latch assembly of claim 9 wherein the upper ridges are flat and positioned horizontally.

11. The latch assembly of claim 9 wherein the upper ridges slope downwardly in a helical direction, wherein the upper ridges slope downwardly at an angle between approximately 30° 45°.

12. The latch assembly of claim 9 wherein the upper ridges form the at least two notches and also form at least two hooks on the outer surface of the northern end of the valve rod guide, each hook and each notch being adapted to engage a corresponding prong of the top latch portion.

13. The latch assembly of claim 12 wherein each notch comprises a top portion that prevents the corresponding prong of the top latch portion from moving upwardly once the corresponding prong has engaged the hook and the notch.

14. The latch assembly of claim 12 wherein each notch comprises a side portion that prevents the corresponding prong of the top latch portion from moving laterally in one direction once the corresponding prong has engaged the hook and the notch.

15. The latch assembly of claim 12 wherein the valve rod guide further comprises a lower ridge formed on an outer surface of the valve rod guide and positioned between the northern end of the valve rod guide and a middle section of the valve rod guide, wherein the lower ridge forms a bottom portion of each notch.

16. A latch assembly for use with a pumping mechanism comprising:

a top latch portion, the top latch portion comprising:

a body;

a center channel formed through a length of the body, wherein the center channel is adapted to receive a valve rod;

an annular ridge formed within the center channel; and at least two prongs extending downwardly from the body, each prong comprising an outer surface and an inner surface, wherein the outer surface of each prong is substantially coplanar with an outer surface of a southern end of the body;

a spring received within a southern end of the center channel of the body of the top latch portion and positioned between the at least two prongs of the top latch portion, wherein a northern end of the spring abuts the annular ridge within the center channel of the body of the top latch portion; and a valve rod guide, the valve rod guide comprising:

a center channel formed therethrough, wherein the center channel is adapted to receive the valve rod;

two upper ridges formed on an outer surface of a northern end of the valve rod guide, wherein the upper ridges form at least two notches and also form at least two hooks on the outer surface of the northern end of the valve rod guide, each hook and each notch being adapted to engage the inner surface of a corresponding prong of the top latch portion.

17. The latch assembly of claim 16 wherein the prongs of the top latch portion each have a bottom edge, wherein the bottom edges of the prongs are both flat and positioned horizontally and wherein the two upper ridges formed on the outer surface of the northern end of the valve rod guide are flat and positioned horizontally.

18. The latch assembly of claim 16 wherein the prongs of the top latch portion each have a bottom edge, wherein the bottom edges of the prongs both have an angle of approximately 40° and wherein the two upper ridges formed on the outer surface of the northern end of the valve rod guide slope downwardly in a helical direction at an angle of approximately 40°.

19. The latch assembly of claim 16 wherein each notch comprises:

a top portion that prevents the corresponding prong of the top latch portion from moving upwardly once the corresponding prong has engaged the hook and the notch;

a side portion that prevents the corresponding prong of the top latch portion from moving laterally in one direction once the corresponding prong has engaged the hook and the notch, wherein each hook prevents the corresponding prong of the top latch portion from moving laterally in an opposite direction once the corresponding prong has engaged the hook and the notch; and a bottom portion formed by a lower ridge formed on an outer surface of the valve rod guide and positioned between the northern end of the valve rod guide and a middle section of the valve rod guide.

20. The latch assembly of claim 16 further comprising a collet adapter, wherein a southern end of the collet adapter is coupled to the center channel of the top latch portion proximate a northern end of the top latch portion and wherein the collet adapter comprises:

a northern end;

a center channel configured to receive a top end of a valve rod;

a tapered southern end; and a plurality of tapered ears formed by a plurality of slits within the tapered southern end, wherein the tapered ears compress inwardly toward the valve rod to stabilize the valve rod.

* * * * *